US005310088A

United States Patent [19]

Burrows

[11] Patent Number: 5,310,088

[45] Date of Patent: May 10, 1994

[54] BOTTLED WATER STATION FOR DISPENSING CARBONATED AND UNCARBONATED WATER

[75] Inventor: Bruce D. Burrows, Valencia, Calif.

[73] Assignee: Ebtech, Inc., Columbus, Ohio

[21] Appl. No.: 64,872

[22] Filed: May 24, 1993

[51] Int. Cl.[5] ..... B67D 5/62

[52] U.S. Cl. ..... 222/67; 222/129.1; 222/146.6; 62/390

[58] Field of Search ..... 62/390, 394, 306; 222/146.6, 129.1, 67, 185, 144.5; 261/DIG. 7

[56] References Cited

U.S. PATENT DOCUMENTS

| | | | |
|---|---|---|---|
| 3,698,603 | 10/1972 | Radcliffe | 222/146.6 X |
| 3,915,341 | 10/1975 | Brown | 222/129.1 X |
| 4,008,832 | 2/1977 | Rodth | 222/129.1 |
| 4,597,509 | 7/1986 | Pereira | 222/146.6 X |
| 4,940,164 | 7/1990 | Hancock et al. | 222/146.6 X |
| 4,958,747 | 9/1990 | Sheets | 222/146.6 X |
| 4,979,647 | 12/1990 | Hassell | 62/394 X |
| 5,192,004 | 3/1993 | Burrows | 222/146.6 X |

*Primary Examiner*—Andres Kashnikow
*Assistant Examiner*—Anthoula Pomrening
*Attorney, Agent, or Firm*—Kelly Bauersfeld & Lowry

[57] ABSTRACT

A bottled water station is provided for selective dispensing of uncarbonated and carbonated water. The station includes an upper water reservoir adapted to receive water from an inverted supply bottle. The upper reservoir is mounted in stacked relation on a lower carbonator reservoir, and uncarbonated water is dispensed from the upper reservoir via a first dispense conduit extending through the carbonator reservoir and a multiported fitting thereon to a first faucet valve. A portion of the uncarbonated water is diverted from the first dispense conduit and is supplied with a carbonating gas through the multiported fitting to the carbonator reservoir to form carbonated water. The carbonated water is dispensed in turn through a second dispense conduit connected between the multiported fitting and a second faucet valve. A chiller, coil of a suitable refrigeration system is wrapped about the upper and lower reservoir for simultaneous chilling of the water contained therein.

19 Claims, 3 Drawing Sheets

BOTTLED WATER STATION FOR DISPENSING CARBONATED AND UNCARBONATED WATER

BACKGROUND OF THE INVENTION

This invention relates generally to beverage dispensing devices such as a bottled water station, particularly of a type adapted for selective and alternative dispensing of uncarbonated or carbonated water. More specifically, this invention relates to an improved, relatively simple dispensing station having separate supplies of uncarbonated and carbonated water.

Bottled water dispenser stations are well-known in the art for containing a supply of relatively purified water in a convenient manner and location ready for substantially immediate dispensing and use. Such bottled water stations commonly include an upwardly open water reservoir mounted within a station housing and adapted to receive and support an inverted water bottle of typically three to five gallon capacity. Water within the inverted bottle flows downwardly into the station reservoir for selective dispensing therefrom through a faucet valve on the front of the station housing. Such bottled water stations are widely used to provide a clean and safe source of water for drinking and cooking, especially in areas where the local water supply contains or is suspected to contain undesired levels of contaminants.

In recent years, considerable interest has developed in connection with carbonated water dispensers, particularly of a relatively compact and cost-efficient design for use in an in-home or office environment. In this regard, carbonated water dispensers normally comprise a pressurized water tank or reservoir supplied with water and a selected carbonating gas, such as carbon dioxide, for appropriate intermixture to form carbonated water. The carbonated water provides a pleasing and refreshing beverage which can be used to form a soft drink beverage upon appropriate addition of a flavor syrup or the like. See, for example, U.S. Pat. Nos. 5,071,595; 5,073,312; and 5,085,810.

Various attempts have been made to modify a traditional bottled water station for purposes of providing a supply of carbonated water. See, for example, U.S. Pat. No. 4,940,164. In some instances, such modified bottled water stations have been adapted to provide both uncarbonated and carbonated water selected by the individual at the time of water dispensing. While such dual water supply systems are highly beneficial with respect to meeting certain beverage dispensing requirements, the system is necessarily equipped with separate water reservoirs containing the uncarbonated and carbonated water supplies. In the past, especially when the water supplies are refrigerated, a relatively complex and costly bottled water station has resulted, having numerous plumbing connections and fittings to obtain the desired dual water supplies.

The present invention provides an improved bottled water station for selective and alternative dispensing of uncarbonated and carbonated water, wherein the bottled water station has a relatively simplified arrangement of dual water-containing reservoirs, and a correspondingly simplified and cost-efficient construction.

SUMMARY OF THE INVENTION

In accordance with the invention, an improved bottled water station is provided for dispensing uncarbonated water and carbonated water, respectively, through a corresponding pair of manually operated faucet valves. The bottled water station includes an upper water reservoir mounted within a station housing and adapted to receive an incoming flow of uncarbonated water from an inverted water supply bottle or the like. The upper reservoir is assembled in stacked relation on top of a lower carbonator reservoir within which carbonated water is produced and stored. Separate dispense conduits extend from a multiported fitting at the bottom of the carbonator reservoir respectively to the faucet valves, for separate and selected dispensing of uncarbonated or carbonated water.

In the preferred form of the invention, a first dispense conduit extends from the bottom of the upper reservoir through the interior of the carbonator reservoir to the multiported fitting thereon. From the multiported fitting, the first dispense conduit extends further to a first faucet valve for use in selected dispensing of uncarbonated water.

A portion of the uncarbonated water is diverted from the first dispense conduit for pumped delivery into the lower carbonator reservoir. A float switch within the carbonator reservoir maintains the water level therein within predetermined limits. When water is delivered to the carbonator reservoir, a quantity of a carbonating gas such as carbon dioxide is also delivered to the carbonator reservoir to form carbonated water. A second dispense conduit is connected between the carbonator reservoir and a second faucet valve for selective carbonated water dispensing. In accordance with one aspect of the invention, all plumbing connections with the carbonator reservoir are obtained through the multiported fitting adapted for mounting at a lower end of the carbonator reservoir.

The bottled water station is, in the preferred form, equipped with a refrigeration system for chilling the water supplies contained respectively within the stacked reservoirs. The refrigeration system includes a chiller coil wrapped about the stacked reservoirs, with a preferred coil geometry including a pair of coil segments defined by plural contiguous loops around each of the lower and upper reservoirs.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
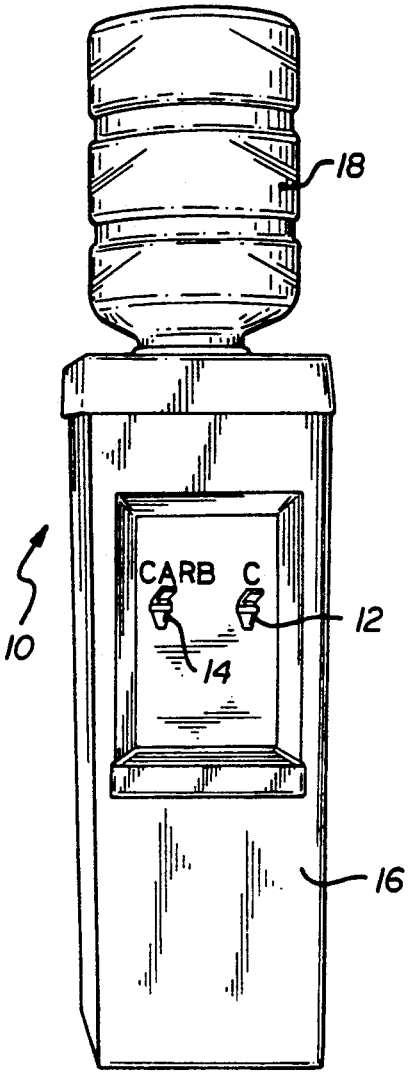
FIG. 1 is a front perspective view illustrating a bottled water station embodying the novel features of the invention.

As shown in the exemplary drawings, a bottled water station referred to generally in FIG. 1 by the reference numeral 10 includes a pair of faucet valves 12 and 14 for selected and separate dispensing of uncarbonated and carbonated water. The improved bottled water station 10 is particularly designed in a compact and cost-efficient manner to provide a versatile beverage dispenser apparatus for use in an in-home or office environment or the like.

The bottled water station 10 has a generally conventional size and shape to include station housing or cabinet 16 adapted to receive and support a water supply bottle 18 in an inverted orientation. As is known in the art, water within the supply bottle 18 flows by gravity into an appropriate water reservoir (not shown in FIG. 1) within the station housing 16. In accordance with the present invention, separate water reservoirs containing uncarbonated and carbonated water are mounted within the station housing for separate dispensing of water via the faucet valves 12 and 14.

Figure 2:
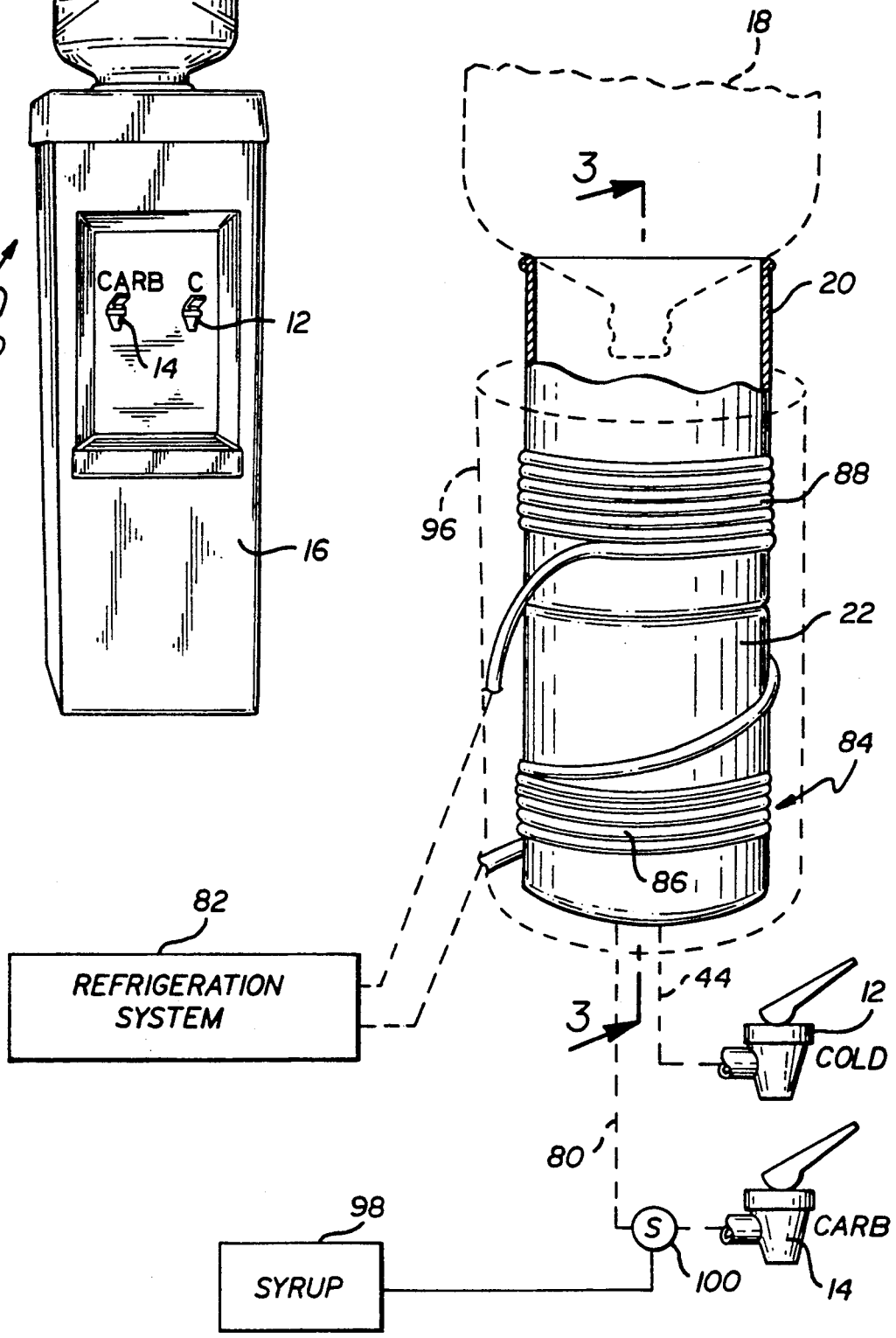
FIG. 2 is a fragmented and somewhat schematic perspective view illustrating upper and lower water reservoirs in vertically stacked relation.
Figure 3:
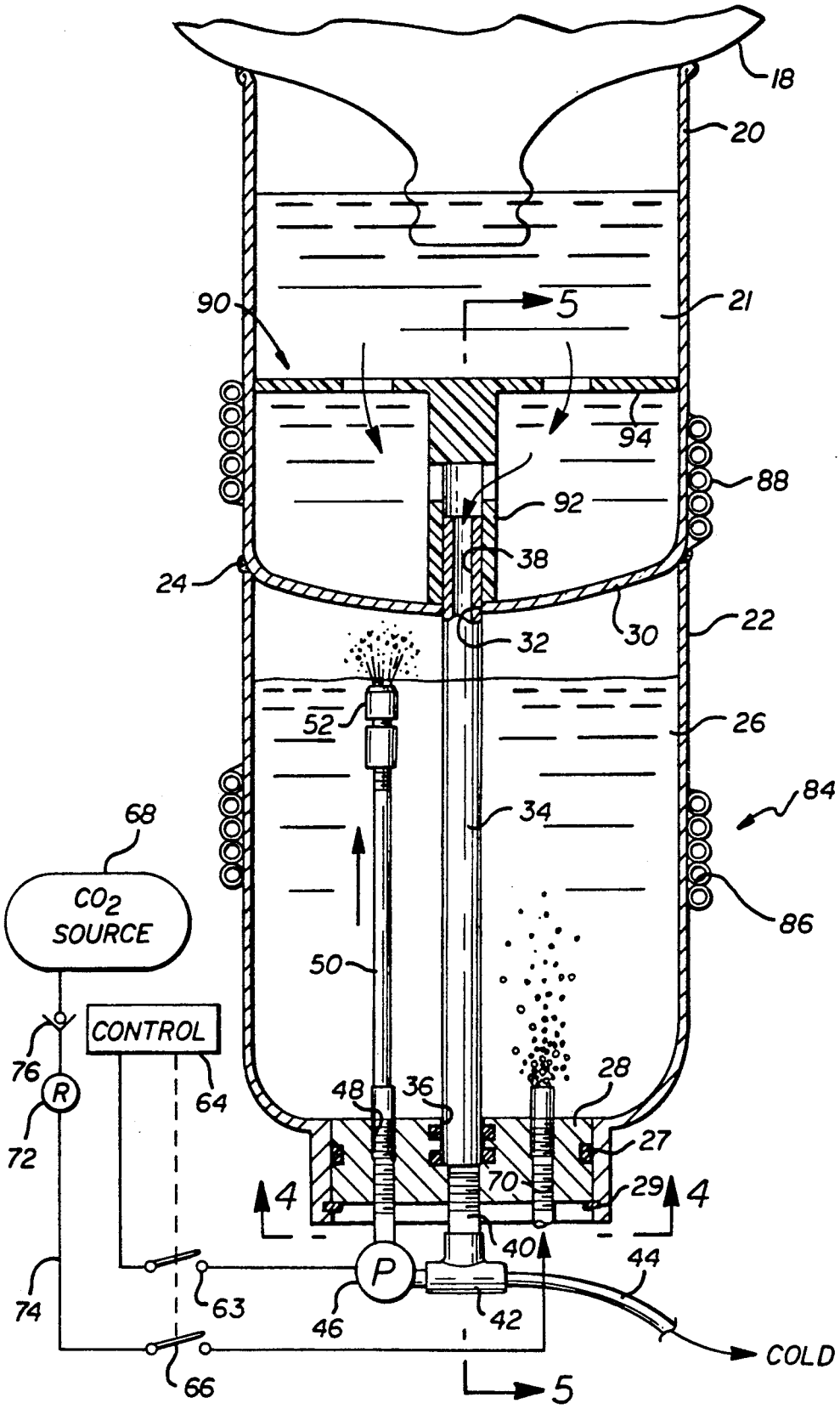
FIG. 3 is an enlarged fragmented vertical sectional view taken generally on the line 3—3 of FIG. 2.
Figure 4:
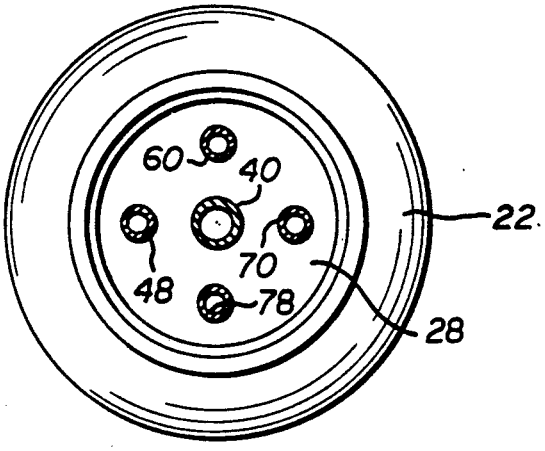
FIG. 4 is a bottom plan view of the stacked reservoirs, taken generally on the line 4—4 of FIG. 3.
Figure 5:
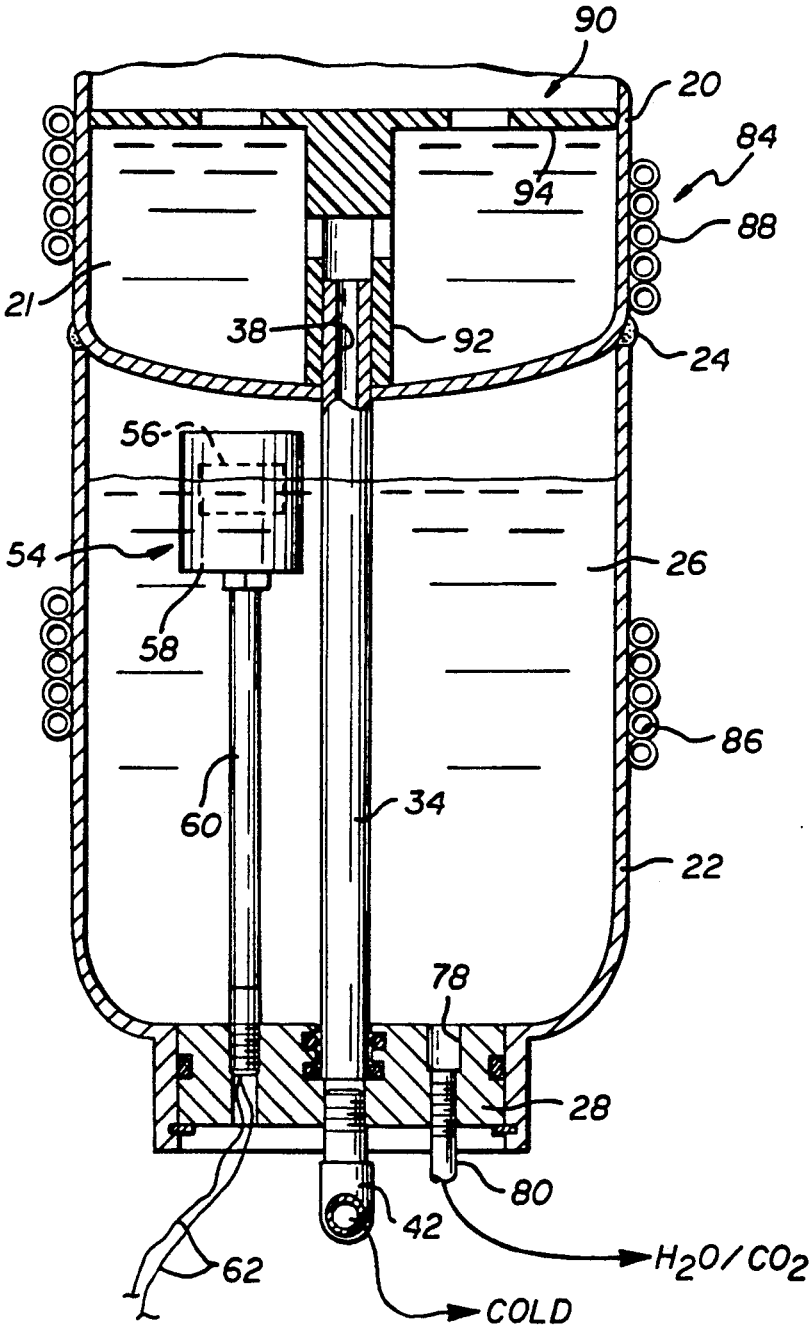
FIG. 5 is a fragmented vertical sectional view, taken generally on the line 5—5 of FIG. 3.

As shown in FIGS. 2, 3 and 5, the water reservoirs within the station housing 16 include an upper reservoir 20 mounted in vertically stacked relation on a lower carbonator reservoir 22. The upper reservoir 20 has an upwardly open configuration which is adapted to receive water downflow from the inverted supply bottle 18. Water within the upper reservoir 20 constitutes the uncarbonated water supply 21 and may be selectively dispensed, as will be described in more detail, by operation of the associated faucet valve 12.

The upper and lower reservoirs 20 and 22 are, in the preferred form, constructed from stainless steel or the like, whereby these reservoir structures can be rigidly and permanently interconnected in vertically stacked relation by means of a circumferential weld 24 (FIG. 3) or the like. With this construction, the lower carbonator reservoir 22 may conveniently comprise a pressure vessel for economical production of carbonated water 26 therein. The produced carbonated water 26 is selectively dispensed, as will be described in more detail, by appropriate operation of the associated faucet valve 14.

As shown best in FIGS. 3 and 5, a multiported fitting 28 is mounted in a sealed manner within an otherwise open lower end of the carbonator reservoir 22. The illustrative mounting means 27 includes at least one seal ring 27 and a retainer ring 29 to hold the fitting within a cylindrical open lower bore formed in the reservoir 22. In general terms, the multiported fitting 28 provides means for facilitated connection of the requisite water and carbonating gas supplies to the lower reservoir 22. In addition, the fitting 28 provides means for facilitated dispensing of the uncarbonated water 21 from the upper reservoir 20, as well as the carbonated water 26 from the lower reservoir 22.

More particularly, a bottom wall 30 of the upper reservoir 20 has a central aperture 32 formed therein. A dispense tube 34 of stainless steel or the like has an upper end mounted as by welding within this aperture 32 to project a short distance into a lower region of the upper reservoir 20. The dispense tube 34 extends downwardly from the upper reservoir 20, through the center of the lower reservoir 22, for seated reception within a sealed bore 36 formed within the multiported fitting 28. Accordingly, the dispense tube 34 defines an open water dispense passage 38 for flow of the uncarbonated water 21 from the upper reservoir 20 through the interior of the lower reservoir 22, to the fitting 28. From the fitting 28, the flow of uncarbonated water is coupled quickly and easily through a short conduit 40 and a tee fitting 42, and further through a tubing line 44 to the dispense faucet valve 12.

The tee fitting 42 permits convenient diversion of a portion of the uncarbonated water flow for recirculation to the carbonator reservoir 22, for purposes of producing the carbonated water supply 26. That is, one outlet of the tee fitting 42 is connected through a positive displacement pump 46, and further through an inflow port 48 on the fitting 28 for delivery to the interior of the carbonator reservoir 22. In the preferred from, this water inflow port to the carbonator reservoir 22 includes a standpipe 50 within the reservoir 22, terminating in a spray nozzle 52 at the upper end thereof for pressure spray delivery of the water into the reservoir interior.

A float switch unit 54 (FIG. 5) is also mounted within the interior of the carbonator reservoir 22 to maintain the water level therein between predetermined upper and lower level limits. The illustrative float switch unit 54 includes a buoyant member 56 within a float housing 58 mounted at the upper end of a support tube 60. A suitable float switch unit 54 may comprise, for example, a conventional liquid level float switch of the type marketed by The Gems Sensor Division of Imo Industries, Inc., Plainfield, Conn.

The float switch unit 54 is electrically connected by conductors 62 to a suitable controller 64 (FIG. 3) for operating the water supply pump 46 (FIG. 3). That is, the pump 46 is turned on and off by means of a switch 63 operated by the controller 64 in response to signals received from the float switch unit 54, to maintain the water level within the carbonator reservoir 22 within the predetermined limits. When water is delivered to the reservoir 22, the controller 64 also closes a pneumatic switch 66 to permit supply of a carbonating gas such as carbon dioxide from a pressurized source 68 and through a gas inflow port 70 in the fitting 28. As shown in FIG. 3, the pressurized gas introduced into the reservoir interior produces a vigorous bubbling action for liquid-gas intermixture, and resultant production of carbonated water. A pressure regulator 72 is typically provided along a gas flow line 74, and a quick disconnect fitting 76 is provided to permit periodic replacement of the pressurized gas source 68.

The carbonated water 26 within the carbonator reservoir 22 may also dispensed at any convenient time, by appropriate operation of the associated faucet valve 14. In this regard, a carbonated water outflow port 78 is also provided in the multiported fitting 28, with an appropriate flow conduit 80 coupling the outflow port 78 with the faucet valve 14.

In accordance with further aspects of the invention, the bottled water station includes a refrigeration system 82 (FIG. 2) having a chiller coil 84 for chilling the uncarbonated and carbonated water supplies. As shown, a single chiller coil is provided, wherein the coil is wrapped in discrete multi-loop segments 86 and 88 disposed respectively about the lower and upper reservoirs. With this construction, the same chiller coil may be utilized to chill both water supplies. A baffle plate 90 (FIGS. 3 and 5) may be provided within the upper reservoir, preferably having a ported nipple 92, for slide-fit mounting over the upper end of the dispense tube 34, with a perforated baffle plate 94 subdividing the interior of the upper reservoir 20 into an unrefrigerated upper region and a lower region associated with the chiller coil segment 88. In addition, improved thermal exchange between the chiller coil 84 and the reservoirs 20, 22 may be provided by surrounding a substantial portion of both reservoirs with an insulative thermal exchange material 96 (FIG. 2) of the type described, for example, in copending U.S. patent application Ser. No. 07/955,330, filed Oct. 1, 1992, which is incorporated by reference herein.

If desired as viewed in FIG. 2, the dispensed carbonated water 26 may include a proportioned quantity of a flavor syrup 98, for purposes of providing a flavored and/or sweetened carbonated soft drink beverage. In this regard, the flavor syrup 98 can be drawn in proportional increment into the dispense conduit 80, by use of an appropriate proportioning valve 100, as shown and described, for example, in connection with the water carbonator system described in U.S. Pat. No. 5,071,595, which is incorporated by reference herein.

The improved bottled water station of the present invention thus provides a compact and cost-efficient arrangement for conveniently producing a carbonated water supply, and for dispensing that carbonated water supply in selected parallel relation with an uncarbonated water supply. The dispensing station can thus be accessed by an individual for an uncarbonated or carbonated beverage, whereby the dispensing station can be used to meet a wide range of individual user preferences.

A variety of further modifications and improvements to the bottled water dispenser station of the present invention will be apparent to those skilled in the art. Accordingly, no limitation on the invention is intended by way of the foregoing description and accompanying drawings, except as set forth in the appended claims.

What is claimed is:

1. A water supply station, comprising:

upper and lower reservoirs mounted in stacked relation and adapted to receive and store uncarbonated water within said upper reservoir and carbonated water within said lower reservoir;

first and second faucet valves for respectively dispensing water from said upper and lower reservoirs;

a first dispense conduit connected between said upper reservoir and said first faucet valve, said first dispense conduit extending from a lower end of said upper reservoir and through at least a portion of the interior of said lower reservoir;

means for delivering a portion of the uncarbonated water from said upper reservoir to said lower reservoir;

means for delivering a carbonating gas to said lower reservoir for mixture with the water therein to form carbonated water; and a second dispense conduit connected between said lower reservoir and said second faucet valve.

2. The water supply station of claim 1 further including refrigeration means for chilling the water within said upper and lower reservoirs.

3. The water supply station of claim 2 wherein said refrigeration means includes a chiller coil having a first coiled segment wrapped about said lower reservoir, and a second coiled segment wrapped about said upper reservoir.

4. The water supply station of claim 1 wherein said upper and lower reservoirs are mounted within a station housing, said first and second faucet valves being mounted on the exterior of said housing for manual operation to dispense water.

5. The water supply station of claim 4 wherein said upper reservoir is upwardly open to permit water flow into said upper reservoir from an inverted water supply bottle.

6. The water supply station of claim 5 wherein said station housing includes means for receiving and supporting an inverted water supply bottle in a position for downward water flow from the bottle into said upper reservoir.

7. The water supply station of claim 1 wherein said means for delivering a portion of the uncarbonated water to said lower reservoir comprises a pump.

8. The water supply station of claim 7 wherein said means for delivering the selected carbonating gas to said lower reservoir comprises a pressurized gas source.

9. The water supply station of claim 1 wherein said means for delivering a portion of the uncarbonated water to said lower reservoir comprises pump means for diverting a portion of the water from said first dispense conduit to said lower reservoir.

10. The water supply station of claim 1 including control means for maintaining the water level within said lower reservoir within predetermined level limits, said control means including means for concurrently operating said water and gas delivery means when the water level within said lower reservoir falls to a predetermined lower level limit.

11. The water supply station of claim 10 wherein said control means includes a float switch within said lower reservoir.

12. The water supply station of claim 1 wherein said lower reservoir includes a multiported fitting at a lower end thereof, said first dispense conduit extending through said fitting, and said second dispense conduit being connected to said fitting.

13. The water supply station of claim 12 wherein said water and gas delivering means include conduits connected to said multiported fitting.

14. A water supply station, comprising:

upper and lower reservoirs mounted in stacked relation and adapted to receive and store uncarbonated water within said upper reservoir and carbonated water within said lower reservoir;

first and second faucet valves for respectively dispensing water from said upper and lower reservoirs;

said lower reservoir having a multiported fitting at a lower end thereof;

a first dispense conduit connected between said upper reservoir and said first faucet valve, said first dispense conduit extending from a lower end of said upper reservoir and through the interior of said lower reservoir, and further through said fitting to said first faucet valve;

pump means for diverting a portion of the water within said first dispense conduit through said fitting to said lower reservoir;

carbonating gas supply means for delivering a selected carbonating gas through said fitting to said lower reservoir; and a second dispense conduit connected between said lower reservoir via said fitting and said second faucet valve.

15. The water supply station of claim 14 further including refrigeration means for chilling the water within said upper and lower reservoir.

16. The water supply station of claim 15 wherein said refrigeration means includes a chiller coil having a first coiled segment wrapped about said lower reservoir and a second coiled segment wrapped about said upper reservoir.

17. The water supply station of claim 14 wherein said upper reservoir is upwardly open to permit water flow into said upper reservoir from an inverted water supply bottle.

18. The water supply station of claim 14 further including a float switch mounted on said fitting and extending into said lower reservoir, said float switch being responsive to the water level within said lower reservoir to operate said pump means to maintain said water level within predetermined level limits.

19. The water supply station comprising:

a station housing;

upper and lower reservoirs mounted in stacked relation within said housing and adapted to receive and store uncarbonated water within said upper reservoir and carbonated water within said lower reservoir;

first and second faucet valves for respectively dispensing water from said upper and lower reservoirs;

said faucet valves being mounted on said housing on the exterior thereof for manual operation to dispense water;

said station including means for receiving and supporting a water supply bottle in an inverted position, and said upper reservoir being upwardly open to receive water from the inverted supply bottle;

a first dispense conduit connected between said upper reservoir and said first faucet valve, said first dispense conduit extending from a lower end of said upper reservoir and through at least a portion of the interior of said lower reservoir;

means for delivering a portion of the uncarbonated water from said upper reservoir to said lower reservoir;

means for delivering a carbonating gas to said lower reservoir for mixture with the water therein to form carbonated water; and a second dispense conduit connected between said lower reservoir and said second faucet valve.

* * * * *